US005860545A

United States Patent [19]

Bartsch

[11] Patent Number: 5,860,545

[45] Date of Patent: Jan. 19, 1999

[54] PLASTIC BOTTLE CLOSURE WITH SINGLE RELIEF RECESS PROXIMATE TO THE LOWER PERIPHERAL EDGE OF SAID CLOSURE

[75] Inventor: Eric R. Bartsch, Cincinnati, Ohio

[73] Assignee: The Procter & Gamble Company, Cincinnati, Ohio

[21] Appl. No.: 828,852

[22] Filed: Apr. 17, 1997

[51] Int. Cl.[6] ..... B65D 41/46

[52] U.S. Cl. ..... 215/256; 215/254; 215/253; 220/270; 220/276

[58] Field of Search ..... 215/256, 254, 215/253, 252, 250; 220/276, 270

[56] References Cited

U.S. PATENT DOCUMENTS

| | | | |
|---|---|---|---|
| 3,837,519 | 9/1974 | Perry | 215/252 X |
| 3,913,771 | 10/1975 | Acton et al. | 215/256 |
| 4,066,182 | 1/1978 | Allen et al. | 215/256 |
| 4,076,140 | 2/1978 | Perne | 215/256 |
| 4,111,329 | 9/1978 | Lampman | 220/266 |
| 4,190,175 | 2/1980 | Allen | 220/270 |
| 4,244,479 | 1/1981 | Smalley | 215/256 |
| 4,322,010 | 3/1982 | Curry | 215/256 |
| 4,474,304 | 10/1984 | Jacobs | 220/276 |
| 4,485,934 | 12/1984 | Maguire | 215/252 |
| 4,526,282 | 7/1985 | Dutt et al. | 215/252 |
| 4,561,553 | 12/1985 | Crisci | 215/256 |
| 4,572,385 | 2/1986 | Luker | 215/216 |
| 4,667,839 | 5/1987 | Crisci | 215/256 |
| 4,687,114 | 8/1987 | Crisci | 215/256 |
| 4,691,834 | 9/1987 | Bullock, III | 215/232 |
| 4,732,293 | 3/1988 | Landis | 220/276 |
| 4,759,465 | 7/1988 | Landis | 220/276 |
| 4,801,032 | 1/1989 | Crisci | 215/256 |
| 4,819,825 | 4/1989 | Landis | 220/276 |
| 4,966,292 | 10/1990 | Marino | 215/256 |
| 5,027,969 | 7/1991 | Lesquir | 220/270 |
| 5,050,754 | 9/1991 | Marino | 215/256 |
| 5,115,934 | 5/1992 | Nelson | 220/276 |
| 5,174,465 | 12/1992 | Luch et al. | 220/288 |
| 5,249,695 | 10/1993 | Luch et al. | 220/276 |
| 5,303,837 | 4/1994 | Adams et al. | 220/254 |
| 5,307,948 | 5/1994 | Blackburn et al. | 220/269 |
| 5,373,955 | 12/1994 | Marino | 215/256 |
| 5,465,876 | 11/1995 | Crisci | 222/153.1 |
| 5,480,045 | 1/1996 | Molinaro et al. | 215/256 |
| 5,505,325 | 4/1996 | Thompson et al. | 220/254 |
| 5,553,727 | 9/1996 | Molinaro et al. | 215/44 |
| 5,560,504 | 10/1996 | Molinaro | 215/256 |
| 5,603,422 | 2/1997 | Herrmann | 215/256 |

*Primary Examiner*—Stephen K. Cronin
*Assistant Examiner*—Robin Hylton
*Attorney, Agent, or Firm*—William Scott Andes

[57] ABSTRACT

A closure tear handle which prevents damage to the closure tear skirt under large application forces when the closure is applied to the bottle; this invention also provides a tear skirt which is easier for consumers to remove. A weak region is placed at the base of the intersection of the tear handle and the wall of the tear skirt. This weak region of the closure is designed such that upon contact with the neck finish of a bottle, which puts the tear skirt into tension, it attracts the tensile forces and relieves stress from the adjacent weak point of the closure tear skirt to prevent damage to this area that would be offensive to consumers and result in wasted product.

1 Claim, 3 Drawing Sheets

PLASTIC BOTTLE CLOSURE WITH SINGLE RELIEF RECESS PROXIMATE TO THE LOWER PERIPHERAL EDGE OF SAID CLOSURE

FIELD OF THE INVENTION

The present invention relates to plastic bottle closures. The present invention has further relation to such closures with improved tear tabs.

BACKGROUND OF THE INVENTION

Tamper evident closures with tear handles are well known in the prior art. Generally, prior embodiments of these closures have included a tear handle to be grasped by the consumer and pulled such that a frangible portion of the closure wall is broken allowing an annular portion of the closure wall to be removed, thus permitting the consumer to remove the reclosable upper portion of the closure from the bottle. The removable portion of the closure wall is defined by an annular line of weakness and a vertical line of weakness to allow this portion to be easily removed from the remaining re-closable upper portion of the closure. Prior closures of this type may be seen in U.S. Pats. No. 4,066,182, 4,687,114, and 4,801,032. It is common for the lower portion of the closure tear strip to come into contact with a downwardly sloped portion of the bottle neck finish, and for the lower portion of the tear strip and the corresponding portion of the bottle neck finish to be forced together at a relatively high pressure during the bottle capping process; this may result in rupture of the vertical line of weakness during capping. It is also common for these closures to be produced such that the fit between the lower portion of the closure and the bottle neck finish is loose enough to prevent the vertical line of weakness from being ruptured during capping. However, this loose fit also may create a gap between the lower portion of the closure and the bottle neck finish which could facilitate tampering.

Closures have been detailed in the prior art which use other means to eliminate this gap and improve tamper resistance as seen in U.S. Pats. No. 4,190,175, 5,027,969, and 5,307,948. These designs place a removable barrier on the bottle which prevents access to the lower region of the closure. This eliminates the need for a tight fit between the closure and the bottle. However, it is difficult to reproduce these features on a typical blow molded bottle with the accuracy and low cost that are possible on a standard injection molded or compression molded closure.

The present invention provides a novel tear handle which prevents damage to the vertical line of weakness in the removable portion of the closure wall when large forces are applied to the top surface of the closure during capping. The tear handle has a weak region which is designed to deform under pressure and shield the vertical line of weakness from high forces which can cause the vertical line of weakness to fracture. Shielding the vertical line of weakness from excessive capping forces allows the closure to be designed to fit the bottle more closely. This improved fit between the closure and bottle improves the tamper resistance of the closure as it is installed on the bottle.

There has therefore been a desire to have an improved bottle closure with an improved tamper evident tear strip which does not fracture during the capping operation, which provides for a better, tighter fit between bottle and closure, and which is easier for the consumer to tear from the container than tear strips in the prior art.

SUMMARY OF THE INVENTION

Disclosed is a plastic closure for a bottle, having a capping portion, and an annular tear skirt attached to the capping portion by an annular line of weakness formed into the closure. The tear skirt has a lower peripheral edge, and a starter line of weakness formed into the tear skirt from the annular line of weakness to the lower peripheral edge. A tear tab is attached to the tear skirt proximate to the starter line of weakness, such that pulling on the tear tab will fracture the starter line of weakness. A relief recess is molded proximate to the point of attachment of the tear tab to the tear skirt and proximate to the lower peripheral edge, such that the relief recess acts to reduce the amount of tensile forces exerted on the lower peripheral edge, and therefore on the vertical line of weakness, when the closure is applied to the bottle.

The closure may be used with a container, the container being of a type that has a neck area, a top opening, an annular top surface with a periphery and an inner edge, the inner edge defining the top opening, a top outer rim extending downwardly and outwardly from the periphery of the annular top surface, the top outer rim defining a first plane, a lip formed at the lower edge of the top outer rim, and a bottom outer rim extending outwardly from the neck area. The closure may have a capping portion which covers the opening. The capping portion may also have an inner surface and an outer surface, a first annular portion, the first annular portion defining a second plane, the first plane being substantially parallel to the second plane, the first annular portion further comprising a lip seal which comes into contact with the lip.

A tear skirt extends downwardly from the capping portion. The tear skirt has a bottom foot which comes into pressurized contact with the bottom outer rim such that a compressive force is exerted on the tear skirt, forcing the lip seal into contact with the lip. The tear skirt is attached to the capping portion by an annular line of weakness formed into the closure; it also has a lower peripheral edge. There is a vertical line of weakness formed into the tear skirt from the annular line of weakness to the lower peripheral edge.

A tear tab is attached to the tear skirt proximate to the vertical line of weakness, such that pulling on the tear tab will fracture the vertical line of weakness starting at the lower peripheral edge and continuously up to the annular line of weakness. A relief recess is molded proximate to the point of attachment of the tear tab to the tear skirt and proximate to the lower peripheral edge, such that the relief recess acts to reduce the amount of tensile forces exerted on the lower peripheral edge, and therefore on the vertical line of weakness, when the closure is applied to the bottle.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE INVENTION

Figure 1:
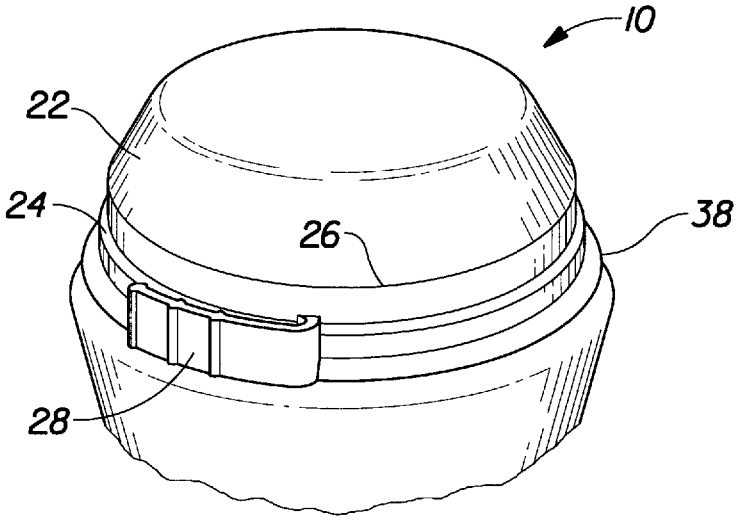
FIG. 1 is a perspective view of one embodiment of a tamper evident closure, as applied to a bottle, that may be used with the present invention.
Figure 2:
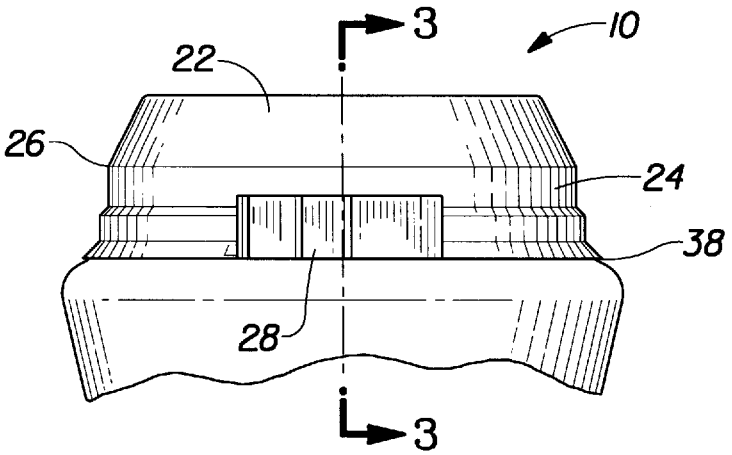
FIG. 2 is an elevational view of the closure of FIG. 1.
Figure 3:
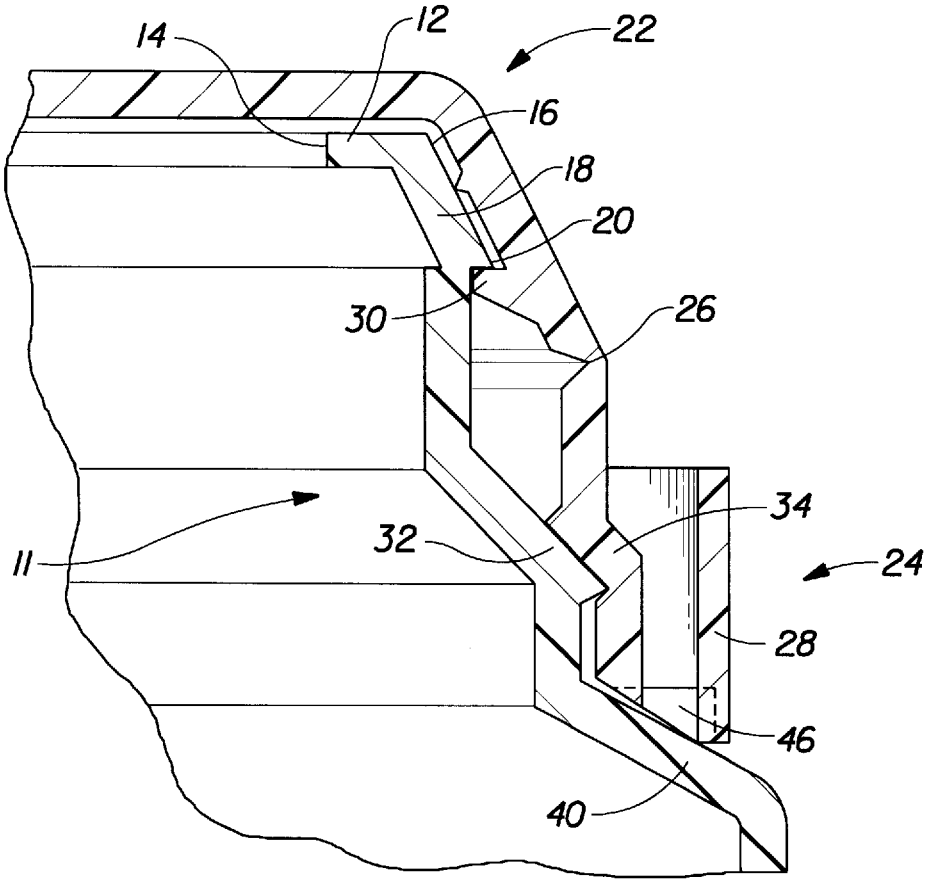
FIG. 3 is a sectional view through lines 3—3 of FIG. 2.
Figure 4:
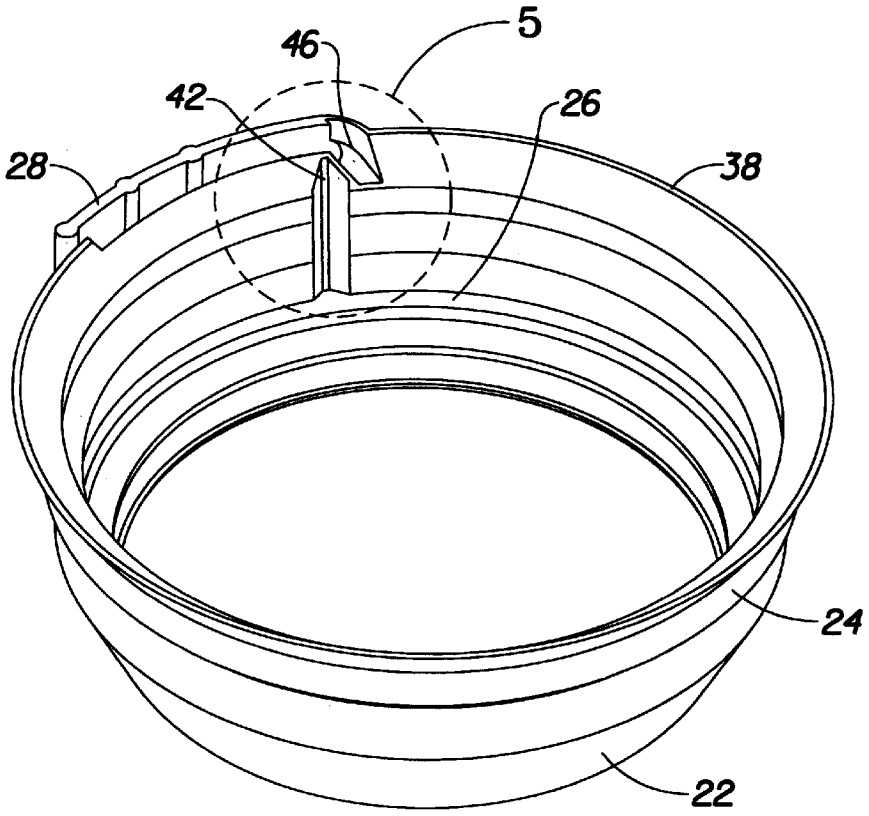
FIG. 4 is a perspective view of the underside of the closure of FIG. 1.
Figure 5:
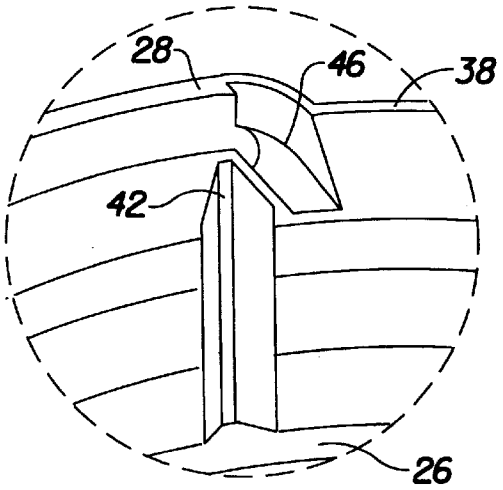
FIG. 5 is an exploded view of the point of attachment of the tear handle to the tear skirt, as it appears in FIG. 4.

Referring now to the drawings in detail wherein like numerals indicate the same element throughout the views, there is shown in FIGS. 1–3 an embodiment of a closure 10 of the present invention as applied to the top of a container. This is just one type of closure, among many, that may be employed with the present invention. Particularly referring to FIG. 3, the container typically has a neck area 11 and an opening. The opening is encompassed by an annular top surface 12, which in turn has an inner edge 14 and a periphery 16. A top outer rim 18 angles downwardly and outwardly from the periphery 16 of annular top surface 12. The lower edge of the top outer rim 18 overhangs a vertical portion of the neck area and forms lip 20. Lip 20 serves as a "seat" for a seal of the closure. Bottom outer rim 32 extends downwardly and outwardly from the lower end of the vertical portion of the neck area and serves as a "seat" for a portion of the closure.

Capping portion 22 of closure 10 is that portion which remains and may be reused after tear skirt 24 is removed from the container. Lip seal 30 is part of capping portion 22; it mates with and engages lip 20. Tear skirt 24 extends downwardly from capping portion 22. They connect at annular line of weakness 26 which is designed to fracture when a consumer pulls on tear tab 28. At the lower end of tear skirt 24 is a bottom foot 34 which is configured to engage with bottom outer rim 32. The area of closure 10 between lip seal 30 and bottom foot 34 is dimensioned with respect to the area of the container between lip 20 and bottom outer rim 32 such that when closure 10 is secured onto the container, a compressive force is exerted on closure 10 between foot 34 and lip seal 30. This results in an enhanced seal between lip 20 and lip seal 30.

Referring to FIGS. 1, 2, 4, and 5, a lower edge 38 may extend downwardly and outwardly from bottom foot 34. This lower edge 38 is forced against bottle surface 40 (see FIG. 3) during the capping operation. As lower edge 38 is forced downwards, it is forced outwards as well, as it slides down surface 40. This downward and outward motion during capping causes a significant amount of tensile force to be exerted generally within tear skirt 24, but specifically about lower edge 38. In prior art closures, this tensile force would accumulate at vertical line of weakness 42, shown in FIGS. 4 and 5, specifically at the point on line of weakness 42 proximate to lower edge 38. This causes fracture of line of weakness 42 in a portion of containers during the capping operation, and as a result, wasted product. This problem is due to the significant thickness of material in prior art closures that is molded at the point tear tab 28 connects to tear skirt 24, an area of increased strength. This area of increased strength funnels tensile forces during the capping operation toward the weakest link—i.e., vertical line of weakness 42—and causes it to fracture.

This problem has been solved by providing a relief recess 46 (see FIGS. 4 and 5), molded into the closure at the point of contact between tear tab 28 and tear skirt 24, proximate to lower edge 38. Recess 46 results in the removal of a portion of the tear tab thickness where it attaches to tear skirt 24 proximate to lower edge 38. Recess 46 results in a decrease of material in this region, which tends to absorb tensile forces during the capping operation, thus relieving vertical line of weakness 42 from these forces and preventing fracture thereof. Applicants have proved with testing that, using this development, extreme forces may be applied during the capping operation with absolutely no damage to vertical line of weakness 42; in fact, the bottle tends to deform before any damage occurs to the novel closure. In addition, recess 46 makes tear skirt 24 easier for consumers to tear off closure 10 when consumption of product from the container is desired, by allowing the line of weakness 42 to be made thinner because it is shielded from the tensile stresses mentioned above and will not fracture as easily.

While particular embodiments of the present invention have been illustrated and described herein it will be obvious to those skilled in the art that various changes and modifications can be made without departing from the spirit and scope of the present invention and it is intended to cover in the appended claims all such modifications that are within the scope of this invention.

What is claimed is:

1. A plastic closure for a bottle, the closure comprising:

(a) a capping portion;

(b) an annular tear skirt attached to the capping portion by an annular line of weakness formed into the closure, the tear skirt having a lower peripheral edge;

(c) a starter line of weakness formed into the tear skirt from the annular line of weakness to the lower peripheral edge;

(d) a tear tab attached to the tear skirt proximate to the starter line of weakness, such that pulling on the tear tab will fracture the starter line of weakness; and (e) a single relief recess proximate to the point of attachment of the tear tab to the tear skirt and proximate to the lower peripheral edge, said relief recess being not longitudinally aligned with said starter line of weakness, such that the relief recess acts to reduce the amount of tensile forces exerted on the lower peripheral edge, and therefore on the starter line of weakness, when the closure is applied to the bottle.

* * * * *